United States Patent [19]

Martin

[11] 4,146,488

[45] Mar. 27, 1979

[54] METAL LUBRICANTS

[75] Inventor: William H. Martin, Yorktown Heights, N.Y.

[73] Assignee: Union Carbide Corporation, New York, N.Y.

[21] Appl. No.: 871,813

[22] Filed: Jan. 24, 1978

[51] Int. Cl.[2] ..... C10M 1/32; C10M 3/26; C10M 1/06; B21B 45/02

[52] U.S. Cl. ..... 252/34.7; 72/42; 252/34; 252/49.3

[58] Field of Search ..... 72/42; 252/34.7, 34, 252/49.3

[56] References Cited

U.S. PATENT DOCUMENTS

| | | | |
|---|---|---|---|
| 2,999,064 | 9/1961 | Sluhan | 252/34.7 |
| 3,418,354 | 12/1968 | Wheeler | 260/408.2 |
| 3,444,080 | 5/1969 | Berger | 252/49.5 |
| 3,445,607 | 7/1969 | Le Suer et al. | 260/408 |
| 3,630,898 | 12/1971 | Teeter et al. | 252/34.7 |
| 3,699,057 | 10/1972 | Halko et al. | 252/49.3 |
| 3,769,214 | 10/1973 | Davis | 252/34 |

*Primary Examiner*—Delbert E. Gantz
*Assistant Examiner*—Irving Vaughn
*Attorney, Agent, or Firm*—Bernard Francis Crowe

[57] ABSTRACT

Metal lubricants having solubility in soft or hard water, excellent cutting, grinding, forming and machine lubrication are provided by poly(oxyalkylene) compounds grafted with about 3 to 15% by weight of acrylic or methacrylic acid followed by neutralization with an alkanolamine.

7 Claims, No Drawings

METAL LUBRICANTS

BACKGROUND OF THE INVENTION

This invention pertains to a method for lubricating metals and more particularly to the use of acrylic or methacrylic acid graft copolymers of poly(oxyalkylene) compounds neutralized with alkanolamines.

Fatty acids have historically been used as metalworking lubricants for forming, shaping, cutting, and grinding metals. They have also been used as co-lubricants and lubricant additives. These fatty acids containing one or more carboxyl groups per molecule have been derived from animal, vegetable and mineral sources. These fatty acids have been used as such in the acid form but are often neutralized with a base to make a soap. Common bases used for this purpose include alkali metal hydroxides and strong amines. These fatty acids may be saturated, e.g., stearic or lauric acids or they may be unsaturated, such as oleic or ricinoleic acids. Examples of soaps are delineated in Chemical Engineering, Volume 61, page 142, June 1954. Initially the fatty acid lubricants were used alone as frictional modifiers. As the art improved, the fatty acids were diluted with water and the resultant aqueous lubricants gave generally better performance, improved cooling and were lower in cost. In metalworking, the forming, shaping, cutting or grinding of metal generates considerable heat and the emphasis toward aqueous lubricants to obtain higher machining speeds at reduced costs occurred.

The next change to occur in the use of fatty acids lubricants was the combination of the acid with another lubricant. In aqueous lubricants the fatty acids, usually as the triethanolamine soap were combined with ethylene or propylene oxide polymers such as polyalkylene glycols. These combinations were particularly useful in chipless metalforming or shaping and to some extent in metal removing operations (cutting or grinding) where the liquid lubricant desirably keeps the metal surfaces separated. Good lubrication is obtained if the lubricant when subjected to high pressures between two surfaces continues to prevent direct contact of these surfaces. Therefore the capacity to withstand extreme pressures between surfaces is an important consideration in metalworking operations.

Water soluble copolymers of ethylene and propylene oxide have been most useful as co-lubricants with fatty acids for metalworking operations. These poly(alkylene) oxide polymers function because of their ability to deposit polymer onto the surfaces of the metal to be lubricated. This occurs because of the inverse solubility characteristics of these polymers. The heat and pressure at the point where lubrication is needed raises the solution's temperature above the polymer's cloud point. Therefore when polyalkylene glycol polymers and fatty acids have been used together, films are deposited which have greatly improved lubrication and antifunctional qualities. Aqueous solutions of fatty acids alone do not provide these advantages.

Polyalkylene glycol polymers have been combined with fatty acids in two ways for improved aqueous metalworking fluids. In the first method the components are simply mixed together with the fatty acids in the form of a triethanolamine salt in order to improve water solubility. In the second method poly(alkylene oxide) polymers have been combined with a fatty acid by esterification of the terminal hydroxyl group of the polymer with the carboxyl group of the fatty acid.

Despite the advantages of the prior poly(alkylene glycol) polymer/fatty acid lubricant combinations they suffer from several significant limitations. First of all amine salts of fatty acids are not stable in hard water. Stability in hard water is an important requirement since most industrial water used to dilute metalworking fluids is hard, containing calcium and/or magnesium cations in varying amounts. While inorganic salts of calcium or magnesium are generally soluble in water, organic salts are seldom soluble. Therefore, carboxylic acid salts which are water soluble as amine soaps, often precipitate from hard waters since they are not soluble as the calcium or magnesium soap. Inasmuch as lubrication and corrosion inhibition benefits are dependent upon a combination of two materials, preferential extraction or precipitation of one material is undesirable.

A second limitation of the above-described lubricant combinations is their tendency to foam excessively. This is a serious problem since the alkanolamine soaps of fatty acids can generate large amounts of foam which does not collapse, particularly in softer waters. This foaming tendency is a major barrier preventing the use of chelating agents to complex calcium and magnesium ions, since softening the water to improve fatty acid stability can often result in excessive foaming.

A third limitation of the above-described lubricant combinations is the difficulty of their preparation without the use of a neutral co-solvent to effect mixing of the two components. Any components added solely to provide a homogeneous mixture and do not contribute to performance characteristics obviously increase the cost of the commercial product. Conversely any reduction in the amount of co-solvent used is highly desirable.

STATEMENT OF THE INVENTION

It has now been found that metals may be lubricated with a liquid medium consisting essentially of water having dissolved therein a salt obtained by neutralizing an acrylic or methacrylic acid graft copolymer of a poly(oxyalkylene) compound having the formula:

$$R''[OC_nH_{2n})_zOR']_a$$

wherein R'' is a hydrocarbon radical free of aliphatic unsaturation and having a valence of a, a is an integer having a value of 1 to about 4, R' is a member selected from a group consisting of a monovalent hydrocarbon radical free of aliphatic unsaturation, a hydrogen atom or an acyl radical free of aliphatic saturation, n has a value of 2 to 4 inclusive, z is an integer having a value of from 8 to 800 inclusive, and preferably 12 to about 500 with an alkanolamine having the formula:

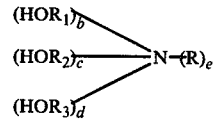

wherein R is hydrogen or alkyl having 1 to about 4 cations, each of $R_1$, $R_2$ and $R_3$ is an alkylene radical having 2 to 4 carbon atoms, e is an integer having values of 0, 1 or 2, b, c, and d are integers each having a value of 0 or 1 with the proviso that when b, c and d are each 1 then e is 0, and wherein the graft copolymer contains about 3 to about 15% by weight of acrylic or methacrylic acid graft copolymerized therein.

The poly(alkylene oxide) compounds used to make the graft copolymers are known in the art. These are commonly produced by reacting an alkylene oxide or a mixture of alkylene oxides with an alcohol. Such alcohols can be monohydric or polyhydric and correspond to the formula $R''(OH)_a$ wherein R'' and a are as defined above. Such alcohols include methanol, ethanol, propanol, butanol, ethylene glycol, glycerol, the monoethylether of glycerol, the dimethyl ether of glycerol, sorbitol, 1,2,6-hexanetriol, trimethylolpropane, and the like.

Preferably, the poly(oxyalkylene) compounds used in this invention have molecular weights (number average) in the range to about 400 to about 35,000 and more preferably in the range to about 1500 to about 4000.

The grafting of the acrylic acid or methacrylic acid onto the poly(oxyalkylene) compounds can be carried out by free radical initiated polymerization reactions known in the art to afford an acrylic acid or a methacrylic acid content of about 3 to about 15% by weight of the total graft copolymer. It is preferred that the graft copolymers contain about 3 to about 8% by weight acrylic or methacrylic acid graft copolymerized therein.

The neutralization of the graft copolymers with the alkanolamine is conveniently carried out by mixing the components with conventional mixing equipment in the presence or absence of water. It is preferred to employ a trialkanolamine but mono- and di-alkanolamines can also be used. The preferred trialkanolamine is triethanolamine although others, such as, trimethanolamine, methyldiethanolamine, tripropanolamine, diethylmonopropanolamine, tributanolamine, and the like can also be used if desired. Exemplary monoalkanolamines include monoethanolamine, monopropanolamine, N-methyl ethanolamine, N,N-dimethyl ethanolamine, N,N-diethyl ethanolamine, and the like. Exemplary dialkanolamines include diethanolamine, dibutanolamine, N-methyl diethanolamine, N-ethyl ethanolamine, and the like.

The concentration of the neutralized graft copolymers in the aqueous medium used for lubricating metals, is not narrowly critical. Generally, the best results are provided by an aqueous solution comprising from about 0.1% to about 30% by weight of neutralized graft copolymer and from 99.9% to about 45% by weight of water, suitable percentages of other materials known in the art being added to modify the corrosion protection properties of the medium or to obtain other desired metal characteristics. In the latter respect it has been found that additives, such as, wetting agents, surfactants, emulsifiers, biocides, coloring agents, odor masking aids, perfumes, antifoams, co-lubricants, dispersants, corrosion inhibitors, and other materials may be employed without effecting the functional properties of the present invention.

The invention is further described in the examples which follow. All parts and percentages are by weight unless otherwise specified.

EXAMPLES 1–3

A graft copolymer was prepared by feeding 640 g. of a butanol started ethylene oxide/propylene oxide (50/50 by weight) polyalkylene oxide having a viscosity of 5100 SUS at 100° F. (37.5° C.) and a molecular weight of about 4500) containing 2.5g. of azobisisobutyronitrile as a stream in to one neck of a 3-necked round bottom reaction flask fitted with a stirrer and thermometer together with a stream of 30g. of acrylic acid monomer into a second neck of the flask over a period of 1.5 hours while maintaining the flask at a temperature of about 150° C. The reaction mass was then post-heated for 1 hour at 150° C. and then transferred to a larger flask where it was stripped with a rotary evaporator at 100° C./11 mm for 1 hour to remove unreacted starting materials. An acrylic acid/polyalkylene oxide graft copolymer containing 3.1% by weight of acrylic acid graft polymerized therein was thus obtained (Graft Copolymer A).

The above procedure was repeated except that the amounts of acrylic acid monomer charged used were 50g. and 80g. respectively. There was thus obtained acrylic acid/polyalkylene oxide graft copolymers containing 5.3% by weight (Graft Copolymer B) and 8.7% by weight (Graft Copolymer C) copolymerized therein.

Then 15g. samples of each of Graft Copolymers A, B and C were dissolved in 15g. of water. The resultant solutions were neutralized with 14.3g., 16.5g. and 24.2g. respectively of triethanolamine (99% pure). The homogeneous solutions which resulted had a pH of 9.

These Examples demonstrate that all three triethanolamine salts are readily soluble in water, one criterion for a metalworking lubricant.

EXAMPLES 4–6

As an estension of the properties demonstrated in Examples 1–3, samples of the Graft Copolymers A, B and C were neutralized with amounts of triethanolamine in excess of the stoichiometric amount in bulk without the benefit of the mutual cosolvent water. The amounts used were 33, 35 and 51 parts of triethanolamine per 100 parts of Graft Copolymers A, B and C respectively. In each case a clear, homogeneous mixture having a pH of 8.5 was obtained. By way of contrast when 40 parts of triethanolamine was blended with 8 parts of a commercial dimer acid (prepared by heating linoleic acid and having an acid value of 186–194 g. KOH/g. of acid and a saponification value of 191–199 g. KOH/g. of acids) and 100 parts of the polyalkylene oxide used to make the Graft Copolymers described in Examples 1–3, the product (Control B) was hazy and separated into two layers.

When 35 g. of triethanolamine was blended with 100 g. of the polyalkylene oxide used to make the Graft Copolymer, the product was hazy and separated into two layers (Control A).

The homogeneity of the alkanolamine salt provides another advantage over some of the prior art additives used in formulating metalworking compositions.

EXAMPLES 7–9

The forming characteristics of the three triethanolamine salts prepared in Examples 1–3 were evaluated for foam characteristics by dissolving 1.5g. of each in 250 ml. of deionized water to maximize any foaming tendency. Solutions were also made with 1.5g. of the Control A and Control B compositions described in Examples 4–6. These solutions were each charged to the bowl of a Waring Blender with a ruler taped to the outside of the bowl to measure foam height. The bowls were covered and the solutions mixed at rotor speeds of approximately 12,000–15,000 rpm. After one minute the mixing action was stopped and the foam height was recorded in mm. This procedure was repeated 3 more times. The observed data was tabulated in Table 1 together observations as to foaming tendency and foam characteristics. These data indicate that the dimer acid salt stabilizes the foam preventing its collapse which is undersirable in a metalworking lubricant. It was therefore unexpected that the salts in Examples 7, 8 and 9 containing neutralized acid functionalities were comparable to the base polyalkylene oxide/triethanolamine mixture in that the foam generated upon agitation of its aqueous solutions is not stabilized and quickly collapses.

TABLE 1

WARING BLENDER FOAM COMPARISON

| | Control A | Control B | Exp. 7 | Exp. 8 | Exp. 9 |
|---|---|---|---|---|---|
| Foam height, 1 min., mm. | 75 | 75 | 75 | 80 | 70 |
| Foam height, 2 min., mm. | 37 | 58 | 57 | 50 | 50 |
| Foam height, 3 min., mm. | 22 | 55 | 37 | 34 | 32 |
| Foam height, 4 min., mm. | 16 | 52 | 32 | 21 | 28 |
| Foaming Tendency | moderate | moderate | moderate | moderate | moderate |
| Foam Characteristics | collapses | stable | collapses | collapses | collapses |

EXAMPLES 10–12

A synthetic hard water having a hardness of 500 ppm (parts per million) expressed as calcium carbonate was prepared by dissolving 0.492 g. of magnesium sulfate hydrate ($MgSO_4.7H_2O$) and 0.379 g. of calcium chloride ($CaCl_2$) diluted to one liter with deionized water.

The triethanolamine salts prepared in Examples 4–6 were dissolved in this water to afford 1% solutions (weight/volume). Clear, homogeneous solutions were obtained. A similar result was obtained with Control A polyalkylene oxide. Control B however afforded a hazy solution followed by precipitation of dimer acid soap. In view of this phenomenon it was again unexpected that Examples 4–6 would provide clear homogeneous solutions which is another requisite of a commercial metalworking composition.

EXAMPLES 13–15

The evaluation of the triethanolamine salts prepared in Examples 4–6 was effected in a Falex Extreme Pressure Lubrication Tester. In this equipment a rotating pin is squeezed between two steel vee-blocks, the pin and blocks being submerged in the lubricant being tested. The force exerted on the blocks is measured by the jaw load. In the Extreme Pressure Test, and jaw load is gradually and continously increased until the pressure is so intense that momentary spalling or galling (welding) occurs between the rotating pin and the vee-blocks which terminates the test. Rotation of the pin on the vee-blocks produces wear or a scar, the magnitude of which can be measured with a calibrated magnifier. The arrangement is such that the entire force exerted through the jaws is distributed entirely over this area. Therefore, the hydrodynamic film strength of the lubricant can be calculated by dividing the force by the scar area.

The lubricants were tested as 1% by weight aqueous solutions. A five minute break-in at 500 lbs. was used in the Falex test followed by continuous loading until failure.

The data delineated in Table 2 demonstrate that the extreme pressure characteristics of poly(alkylene oxide) (Control A) could not even be tested. Failure occurred at the lowest possible jaw load and during the break-in period. The film strength, 8700 psi, is extremely low. Control B, the combination of equal parts of triethanolamine neutralized dimer acid and polyalkylene oxide, was greatly superior to Control A in extreme pressure characteristics as shown by the full jaw load of 4500 lbs. without galling or seizure of the pin blocks. Scar wear was reduced and the film strength exceeded 100,000 psi. However, triethanolamine neutralized dimer acid alone did not show these extreme pressure capabilities from a 1% aqueous solution. It should also be recalled that the combination in Control B is not a very satisfactory commercial formulation because it separates into two layers in the absence of water or other mutual cosolvents.

Examples 13–15 representing the triethanolamine salts of the graft copolymers prepared in Examples 4–6 showed excellent extreme pressure capabilities in all of the three measurements. In addition as shown in the previous Examples these salts also exhibit the requisite compatability, reduced foamed characteristics and stability in hard waters needed for a commercial water-soluble metalworking lubricant.

TABLE 2

COMPARISON OF LUBRICATION BY FALEX EXTREME PRESSURE LUBRICATION TESTER

| | Control A | Control B | Exp. 13 | Exp. 14 | Exp. 15 |
|---|---|---|---|---|---|
| Max. jaw load before failure, lbs. | <500 | >4500 | 3900 | 4200 | 4100 |
| Scar width, in. | 0.081 | 0.049 | 0.076 | 0.063 | 0.059 |
| Film strength of lubricant at failure, 1. Maximum jaw load in lbs $\sqrt{2} \times 0.5$ scar width | <8700 | 130,000 | 72,500 | 94,300 | 98,300 |

EXAMPLES 16–18

In addition to the criteria discussed previously, it is also desirable that the lubricant be compatible with monoethanolamine-borate, a corrosion inhibitor disclosed in U.S. Pat. No. 3,969,236. Blending a mixture of 2/3 monoethanolamine and 1/3 boric acid with Graft Copolymers A, B and C in a ratio of 80/20 provided a solution of monoethanolamine salts of these copolymers in excess monoethanolamine borate. The Graft Copolymer A solution was hazy and took 1 day standing to separate into two layers. Graft Copolymer B solution was very slightly hazy and required 6–22 days to separate. Graft Copolymer C solution was clear and homogeneous indefinitely. When the Graft Copolymer C solution was diluted with sufficient hard water (500 ppm of $CaCO_3$) to a concentration of 6%, the resultant solution though slightly hazy showed no precipitation upon standing for 85 days. This solution also showed good resistance to foaming when subjected to agitation in the Waring Blender test described in Example 2. The foam heights after 1 minute intervals of stirring were 65 mm., 45 mm., 32 mm., 22 mm., and 16 mm. In contrast a mixture of a 66% monoethanolamine borate, 12% ricinoleic acid and 22% butanol started polyethylene oxide/propylene oxide (50/50) oxide having a viscosity of 2000 SUS at 100° F. (38.5° C.) (Control C) during the same intervals had foam heights of 100 mm., 90+ mm., 90 mm., 85+ mm. and 85+ mm., precipitates in hard water, and separates quickly upon standing.

EXAMPLE 19

The lubrication characteristics of monoethanolamine-borate lubricant mixtures were compared using the Falex extreme pressure tester described above. Test concentrations were 2.0% in water. The method of applying the load is different from the procedure described in Examples 13–15. The pins and blocks were broken in at 250 lbs. for a minute, followed by incremental loadings of 250 lbs. at 30 second intervals. The torque required to rotate the pin between the vee blocks was recorded at each increment. The test was continued until seizure of the pin and blocks occurred or until the maximum load of the Falex tester (4500 lbs.) was reached.

The 80/20 mixture of monoethanolamine-borate/Example 6 (2% aqueous solution) was evaluated in this manner. As shown in Table 3 this formulation permits loading of the Falex tester up to the maximum load without seizure.

TABLE 3

FALEX TEST OF MONOETHANOLAMINE BORATE/GRAFT COPOLYMER SALT

| Load, lbs. | Elapsed Time, in seconds | Torque in. ft./lbs. |
|---|---|---|
| 250 | 60 | 11 |
| 500 | 90 | 12 |
| 750 | 120 | 14 |
| 1000 | 150 | 18 |
| 1250 | 180 | 19 |
| 1500 | 210 | 20 |
| 1750 | 246 | 23 |
| 2000 | 270 | 26 |
| 2250 | 300 | 32 |
| 2500 | 330 | 35 |
| 2750 | 360 | 38 |
| 3000 | 390 | 43 |
| 3250 | 420 | 45 |
| 3500 | 450 | 45 |
| 3750 | 480 | 46 |
| 4000 | 570 | 48 |
| 4250 | 540 | 49 |
| 4500 | 570 | 51 - test terminated without seizure. |

EXAMPLES 20–22

The effect on ferrous corrosion of graft copolymer salts was determined by diluting the Graft Copolymer C solution prepared in Example 18 with hard water (500ppm $CaCO_2$). Diluting said solution 60, 80, and 121 times afforded solutions containing 1.33%, 1.0% and 0.66% respectively of the original Graft Copolymer C solution. Six grams of freshly machined chips from a cast iron bar were slurried in each of the three aqueous solutions for one minute and the excess liquid then decanted. The wetted chips were spread over a circular area, 2 inches in diameter and allowed to dry overnight at 18°–21° C. and a relative humidity of 55–65%. After this the chips were examined visually and rated subjectively for rust formation on a scale of 0 to 10. A 0 rating indicated no rust while a 10 rating indicated complete rusting, i.e., there was no corrosion protection. As shown in Table 4 at all concentrations, the blend of monoethanolamine borate/Graft Copolymer C salt was effective and superior to solutions of monoethanolamine-borate alone (Control D) diluted to the same concentration.

TABLE 4

CAST IRON CORROSION RESISTANCE

| Concentration in water | MEA[1]-borate (Control D) | MEA-borate/Graft Copolymer C solution |
|---|---|---|
| 1.33% | 2+ | 1+ |
| 1.00% | 4+ | 2 |
| 0.66% | 8+ | 4+ |

[1]Monoethanolamine

EXAMPLES 23–29

Additional samples of acrylic acid graft copolymers were prepared as in Examples 1–3 but with t-butyl perbenzoate as the free radical initiator rather than azobisisobutyronitrile. Five levels of acrylic acid were grafted onto a butanol starter ethylene oxide/propylene oxide (50/50) polyalkylene oxide having a viscosity of 5100 SUS at 100° F. (37.5° C.). The graft copolymers obtained respectively contained 5, 8, 10, 12.5 and 15.0% acrylic acid graft copolymerized therein. An additional sample was also prepared from a butanol started ethylene oxide/propylene oxide (50/50) polyalkylene oxide having a viscosity of 660 SUS at 100° F. (37.5° C.) wherein 5% of acrylic acid was graft copolymerized therein. All of the graft copolymers prepared from the 5100 SUS polyalkylene oxide were completely soluble or dispersible with triethanolamine forming only one phase. The graft copolymer from the 660 SUS polyalkylene oxide was not dispersible above about 12 parts of copolymer per 100 parts of triethanolamine. However, this is within the range of useful commercial lubricants.

When these graft copolymers were mixed in 1:1 and 2:1 mole ratios with monoethanolamine-borate it was found that the copolymers containing 8, 10, 12.5 and 15% acrylic acid were homogeneous in both ratios. The two copolymers containing 5% acrylic were not homogeneous but can be made so with the addition of a small amount of co-solvent.

The foaming tendencies of these copolymers neutralized with excess triethanolamine were all low and their stability in hard water (500ppm Ca $CO_3$) after three weeks was excellent for 6% solutions.

Although the invention has been described in its preferred forms with a certain degree of particularity, it is understood that the present disclosure has been made only by way of example, and that numerous changes can be made without departing from the spirit and scope of the invention.

What is claimed is:

1. A method for lubricating metals which comprises contacting said metals with a liquid medium consisting essentially of water having dissolved therein an alkanolamine salt of a poly(oxyalkylene) compound having the formula:

$$R''[(OC_nH_{2n})_zOR']_a$$

wherein R'' is a hydrocarbon radical free of aliphatic unsaturation and having a valence of a, a is an integer having a value of 1 to about 4, R' is a monovalent hydrocarbon radical free of aliphatic unsaturation, or a hydrogen atom or an acyl radical free of aliphatic unsaturation, n has a value from 2 to 4 inclusive, and z is an integer having a value of about 8 to about 800, said poly(oxyalkylene) compound having grafted thereon from about 3 to about 15% by weight of acrylic acid or methacrylic acid, based on the total weight of the resultant graft copolymers, and said salt being the neutralization product of said graft copolymer and an alkanolamine having the formula:

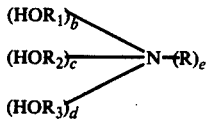

wherein R is hydrogen or alkyl having 1 to about 4 C atoms, each of $R_1$, $R_2$, and $R_3$ is an alkylene radical having 2 to about 4 C atoms, e is an integer having values of 0, 1 or 2, b, c, and d are integers each having a value of 0 or 1 with the proviso that when b, c and d are each 1, e is 0.

2. Method claimed in claim 1 wherein $R_1$, $R_2$, and $R_3$ are each ethylene radicals, b, c and d are each 1 and e is 0.

3. Method claimed in claim 1 wherein $R_1$ and $R_2$ are each ethylene radicals b, c and e are each 1, and d is 0.

4. Method claimed in claim 1 wherein $R_1$ is an ethylene radical, b is 1, e is 2 and c and d are each 0.

5. Method claimed in claim 1 wherein z has a value of about 12 to about 500.

6. Method claimed in claim 1 wherein about 8 to about 12.5% acrylic acid is grafted onto the poly(alkylene oxide) compound.

7. Method claimed in claim 1 wherein the liquid medium contains about 0.1 to about 30 weight percent alkanolamine salt dissolved therein.

* * * * *

UNITED STATES PATENT AND TRADEMARK OFFICE

CERTIFICATE OF CORRECTION

PATENT NO. : 4,146,488

DATED : March 27, 1979

INVENTOR(S) : William H. Martin

It is certified that error appears in the above-identified patent and that said Letters Patent are hereby corrected as shown below:

Colums 5 and 6, Table 2, lines 57 and 58, "1. Maximum jaw load in lbs" and "$\sqrt{2}$ X 0.5 scar width" should read -- 1. $\frac{\text{Maximum jaw load in lbs}}{\sqrt{2} \text{ X } 0.5 \text{ scar width}}$ --

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*